US011523717B2

(12) United States Patent
Araya

(10) Patent No.: US 11,523,717 B2
(45) Date of Patent: Dec. 13, 2022

(54) AIR DISPENSING CHAMBER

(71) Applicant: Gabriel Araya, Pasadena, CA (US)

(72) Inventor: Gabriel Araya, Pasadena, CA (US)

( * ) Notice: Subject to any disclaimer, the term of this patent is extended or adjusted under 35 U.S.C. 154(b) by 0 days.

(21) Appl. No.: 17/123,277

(22) Filed: Dec. 16, 2020

(65) Prior Publication Data

US 2022/0183516 A1 Jun. 16, 2022

(51) Int. Cl.
*A47K 10/48* (2006.01)
*E03C 1/01* (2006.01)

(52) U.S. Cl.
CPC ..... *A47K 10/48* (2013.01); *E03C 1/01* (2013.01)

(58) Field of Classification Search
CPC ..... A47K 10/48; A61H 2033/061; E03C 1/01
See application file for complete search history.

(56) References Cited

U.S. PATENT DOCUMENTS 4,871,900 A * 10/1989 Hickman ..... A47K 10/48 392/380
4,961,272 A * 10/1990 Lee ..... A47K 10/48 34/202
6,829,841 B1 * 12/2004 Edwards ..... A47K 10/48 34/233
2006/0021248 A1 * 2/2006 Symons ..... A47K 10/48 34/283
2020/0077846 A1 * 3/2020 Bertani ..... A47K 10/48
2021/0137324 A1 * 5/2021 Verheul ..... F04D 25/0673

* cited by examiner

*Primary Examiner* — Janie M Loeppke
(74) *Attorney, Agent, or Firm* — The Iwashko Law Firm, PLLC; Lev Ivan Gabriel Iwashko

(57) ABSTRACT

An air dispensing chamber, including a main body, a plurality of fans circumferentially disposed within at least a portion of the main body to blow air toward a center of the main body in response to rotation of the plurality of fans, and a drainage unit disposed within at least a portion of the main body to receive a liquid therein.

4 Claims, 3 Drawing Sheets

AIR DISPENSING CHAMBER

BACKGROUND

1. Field

The present general inventive concept relates generally to a chamber, and particularly, to an air dispensing chamber.

2. Description of the Related Art

Most people take showers twice per day. Accordingly, a towel is used twice on a daily basis, which requires the towel to be washed frequently for sanitary purposes. Furthermore, residual water from the shower that falls on the ground will pose a safety hazard for any person that goes in the bathroom where the shower is located.

As such, the frequent use of the towel expends more energy resources and is inefficient at drying the person because a level of dryness of the person is dependent on a manner in how the person uses the towel.

Therefore, there is a need for an air dispensing chamber that can efficiently dry a user and prevent excess water from touching the ground.

SUMMARY

The present general inventive concept provides an air dispensing chamber.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing an air dispensing chamber, including a main body, a plurality of fans circumferentially disposed within at least a portion of the main body to blow air toward a center of the main body in response to rotation of the plurality of fans, and a drainage unit disposed within at least a portion of the main body to receive a liquid therein.

The main body may include a weaved surface disposed on an interior surface of the main body to prevent the liquid from moving therethrough, a base disposed on at least a portion of an end of the weaved surface to collect the liquid thereon, and a base wall disposed on at least a portion of an edge of the base to prevent the liquid from moving off the base.

The air dispensing chamber may further include a motor disposed within at least a portion of the base to move the weaved surface around the base in response to rotation of the motor.

The drainage unit may include a drain to collect the liquid therein, and a pump connected to the drain to move liquid into the drain in response to rotation of the pump.

The air dispensing chamber may further include a barrier movably disposed on at least a portion of the main body to move from closed in a first position to at least partially opened in a second position, and to move from opened in the second position to closed in the first position.

The air dispensing chamber may further include at least one induction coil disposed within at least a portion of the main body to emit heat therefrom.

BRIEF DESCRIPTION OF THE DRAWINGS

These and/or other features and utilities of the present generally inventive concept will become apparent and more readily appreciated from the following description of the embodiments, taken in conjunction with the accompanying drawings of which.

DETAILED DESCRIPTION

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

LIST OF COMPONENTS

Air Dispensing Chamber 100
Main Body 110

Weaved Surface 111
Base 112
Base Wall 113
Barrier 120
First Portion 121
Second Portion 122
Fans 130
Induction Coil 140
Control Lever 150
Drainage Unit 160
Drain 161
Pump 162
Disposal 163
Motor 170
Power Source 180

Figure 1:
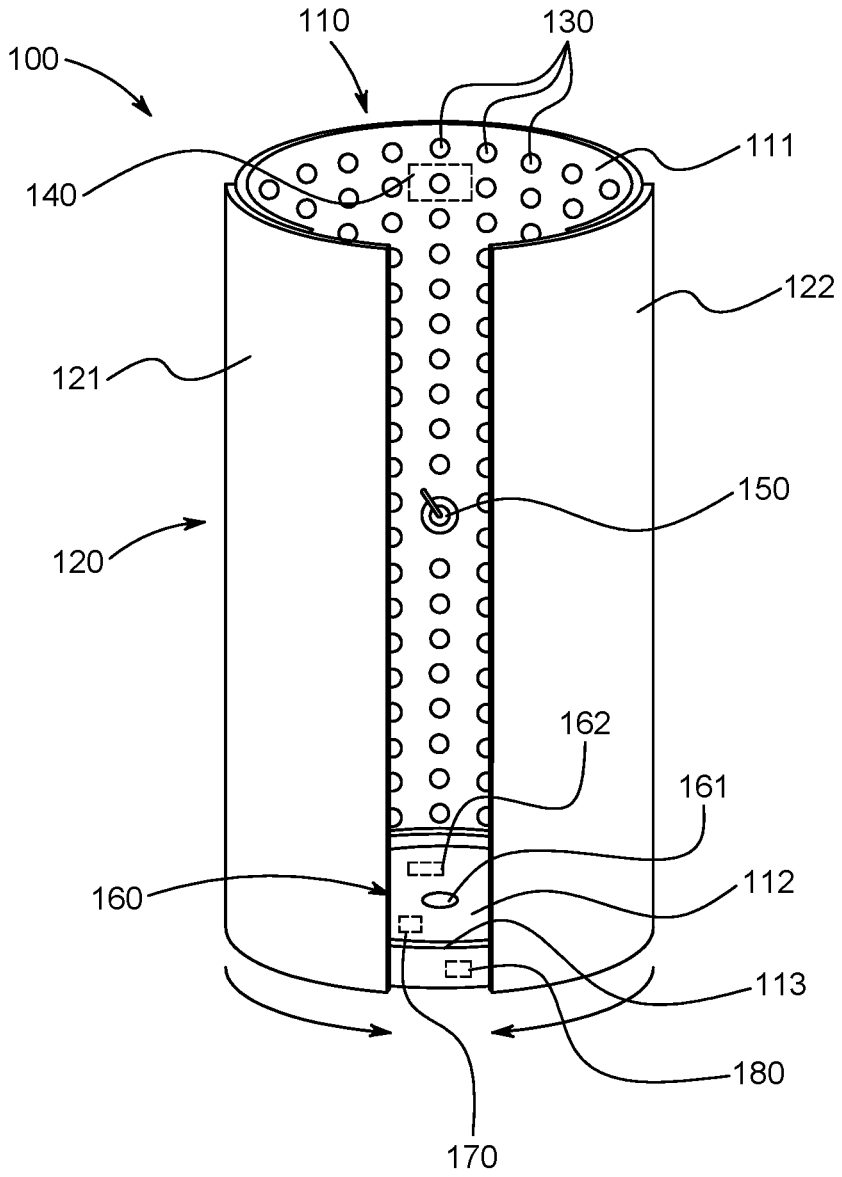
FIG. 1 illustrates a front perspective view of an air dispensing chamber, according to an exemplary embodiment of the present general inventive concept.

FIG. 1 illustrates a front perspective view of an air dispensing chamber 100, according to an exemplary embodiment of the present general inventive concept.

Figure 2:
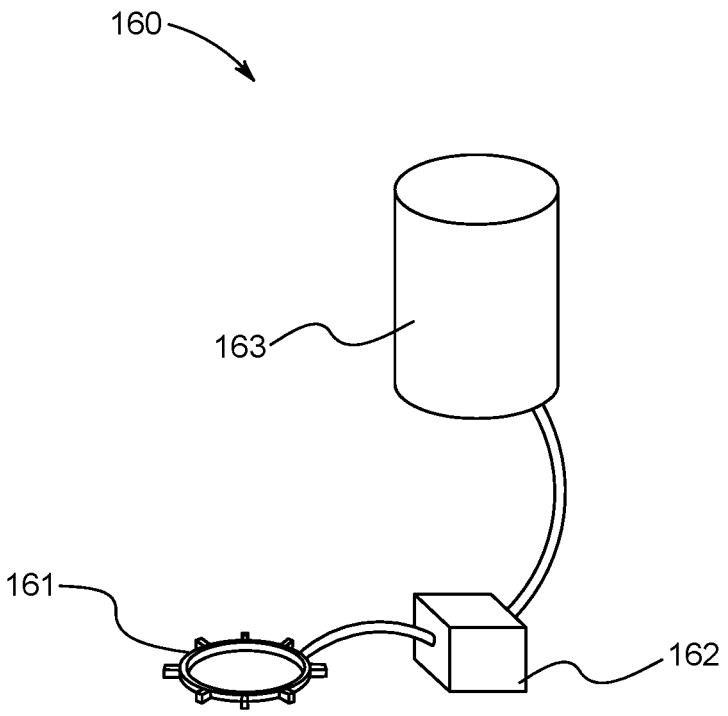
FIG. 2 illustrates a zoomed in view of a drainage unit, according to an exemplary embodiment of the present general inventive concept.

FIG. 2 illustrates a zoomed in view of a drainage unit 160, according to an exemplary embodiment of the present general inventive concept.

Figure 3:
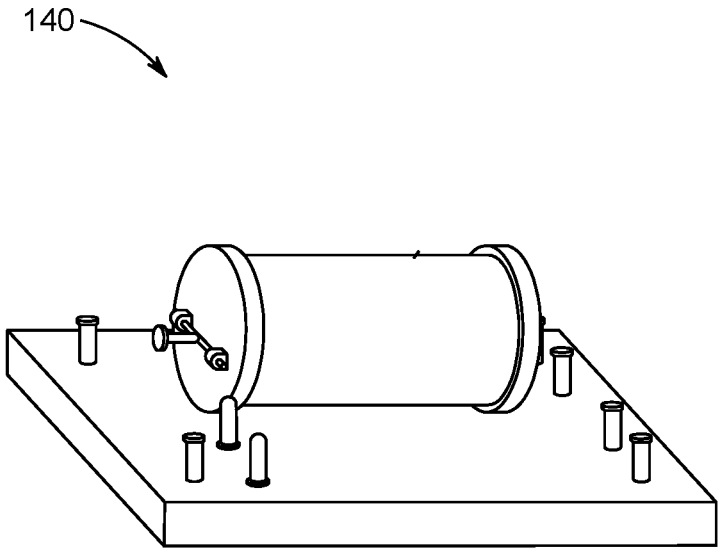
FIG. 3 illustrates a zoomed in view of at least one induction coil, according to an exemplary embodiment of the present general inventive concept.

FIG. 3 illustrates a zoomed in view of at least one induction coil 140, according to an exemplary embodiment of the present general inventive concept.

The air dispensing chamber 100 may be constructed from at least one of metal, plastic, wood, and rubber, etc., but is not limited thereto.

The air dispensing chamber 100 may include a main body 110, a barrier 120, a plurality of fans 130, at least one induction coil 140, a control lever 150, a drainage unit 160, a motor 170, and a power source 180, but is not limited thereto.

Referring to FIG. 1, the main body 110 is illustrated to have a cylindrical shape. However, the main body 110 may be a rectangular prism, circular, conical, triangular, pentagonal, hexagonal, heptagonal, octagonal, or any other shape known to one of ordinary skill in the art, but is not limited thereto.

The main body 110 may receive a user therein. Specifically, the main body 110 may the receive the user subsequent to the user taking a shower.

The main body 110 may include a weaved surface 111, a base 112, and a base wall 113, but is not limited thereto.

The weaved surface 111 may include a plurality of waterproof fibers. For example, the weaved surface 111 may be neoprene, polyurethane, and/or nylon. Moreover, the weaved surface 111 may prevent electrocution of the user while a liquid (e.g., water) contacts the weaved surface 111. In other words, the weaved surface 111 may prevent the liquid from moving therethrough.

The base 112 may be disposed on at least a portion of an end of the weaved surface 111. The base 112 may collect the liquid therein.

The base wall 113 may be circumferentially disposed around an edge of the base 112. Also, the base wall 113 may be elevated with respect to the base 112. As such, the base wall 113 may prevent the liquid from moving off the base 112.

The barrier 120 may include a first portion 121 and a second portion 122, but is not limited thereto.

Referring again to FIG. 1, the barrier 120 may be movably (i.e. slidably) disposed on at least a portion of the main body 110. Moreover, the first portion 121 may move from closed in a first position to at least partially opened in a second position in a first lateral direction or a second lateral direction away from the second portion 122. Conversely, the first portion 121 may move from opened in the second position to closed in the first position in the second lateral direction or the first lateral direction toward the second portion 122.

Alternatively, the first portion 121 and/or the second portion 122 may move simultaneously away from each other to open, or simultaneously toward each other to close.

Furthermore, the first portion 121 and/or the second portion 122 may have the weaved surface 111 disposed thereon, such that the first portion 121 and/or the second portion 122 may be waterproof.

The plurality of fans 130 may be disposed on and/or within at least a portion of the weaved surface 111. Additionally, the plurality of fans 130 may be circumferentially disposed on and/or within the main body 110. As such, the plurality of fans 130 may blow air through the weaved surface 111 toward a center of the main body 110 in response to rotation of the plurality of fans 130, such that a body of the user may be dried. Also, the plurality of fans 130 may be visible while disposed on the weaved surface 111, and/or hidden while disposed within the weaved surface 111.

Furthermore, the cylindrical shape of the main body 110 may enhance movement of the air from the plurality of fans 130 due because of a smooth surface inside the main body 110 compared to a rectangular shape.

The at least one induction coil 140 may be disposed within at least a portion of the main body 110. The at least one induction coil 140 may emit heat therefrom.

Referring again to FIG. 1, the control lever 150 may be disposed on at least a portion of the main body 110. Moreover, although the control lever 150 is illustrated as a single control device, the control lever 150 may be a plurality of control devices, such as a button and/or a switch. The control lever 150 may adjust a temperature level and/or a rotation speed of the plurality of fans 130. More specifically, the control level 150 may increase heat emitted from the at least one induction coil 140, such that the plurality of fans 130 blow heat from therefrom. Alternatively, the control lever 150 may reduce heat, such that the at least one induction coil 140 may turn off to prevent heat being emitted. Furthermore, the control level 150 may increase and/or decrease the rotation speed of the plurality of fans 130 based on a preference of the user.

The drainage unit 160 may include a drain 161, a pump 162, and a disposal 163, but is not limited thereto.

The drain 161 may be disposed on and/or within at least a portion of the base 112. The drain 161 may receive the liquid therein. In other words, the drain 161 may collect the liquid therein, such that the liquid may be removed from the base 112.

The pump 162 may be connected to the drain 161. The pump 162 may rotate to move the liquid into the drain 161, such that the drain 161 may collect the liquid in response to rotation of the pump 162.

The disposal 163 may be connected to the pump 162. The disposal 163 may receive the liquid from the pump 162. Moreover, the disposal 163 may be a pipe and/or a container to expel the liquid to an external system, such as a sewage system.

The motor 170 may be disposed within at least a portion of the base 112. Moreover, the motor 170 may move in response to depressing another control lever 150. The weaved surface 111 may rotate on the base 112 in response to rotation of the motor 170. As such, the plurality of fans 130 may dry a larger area of the user in response to rotation of the weaved surface 111.

The power source 180 may include a power inlet, a battery, and a solar cell, but is not limited thereto.

The power source 180 may be disposed within at least a portion of the base 112. The power source 180 may provide power to the barrier 120, the plurality of fans 130, the at least one induction coil 140, the control lever 150, the drainage unit 160, and/or the motor 170.

Therefore, the air dispensing chamber 100 may dry the user in response to rotation of the plurality of fans 130, such that the user may not use a towel. Moreover, the air dispensing chamber 100 may collect excess liquid, such that the air dispensing chamber 100 may prevent the user from slipping on the excess liquid on a ground surface.

The present general inventive concept may include an air dispensing chamber 100, including a main body 110, a plurality of fans 130 circumferentially disposed within at least a portion of the main body 110 to blow air toward a center of the main body 110 in response to rotation of the plurality of fans 130, and a drainage unit 160 disposed within at least a portion of the main body 110 to receive a liquid therein.

The main body 110 may include a weaved surface 111 disposed on an interior surface of the main body 110 to prevent the liquid from moving therethrough, a base 112 disposed on at least a portion of an end of the weaved surface 111 to collect the liquid thereon, and a base wall 113 disposed on at least a portion of an edge of the base 112 to prevent the liquid from moving off the base 112.

The air dispensing chamber 100 may further include a motor 170 disposed within at least a portion of the base 112 to move the weaved surface 111 around the base 112 in response to rotation of the motor 170.

The drainage unit 160 may include a drain 161 to collect the liquid therein, and a pump 162 connected to the drain 161 to move liquid into the drain 161 in response to rotation of the pump 162.

The air dispensing chamber 100 may further include a barrier 120 movably disposed on at least a portion of the main body 110 to move from closed in a first position to at least partially opened in a second position, and to move from opened in the second position to closed in the first position.

The air dispensing chamber 100 may further include at least one induction coil 140 disposed within at least a portion of the main body 110 to emit heat therefrom.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. An air dispensing chamber, comprising:

a main body, comprising:

a weaved surface disposed on an interior surface of the main body to prevent a liquid from moving therethrough, a base disposed on at least a portion of an end of the weaved surface to collect the liquid thereon, and a base wall disposed on at least a portion of an edge of the base to prevent the liquid from moving off the base;

a motor disposed within at least a portion of the base to move the weaved surface around the base in response to rotation of the motor;

a plurality of fans circumferentially disposed within at least a portion of the main body to blow air toward a center of the main body in response to rotation of the plurality of fans; and a drainage unit disposed within at least a portion of the main body to receive the liquid therein.

2. The air dispensing chamber of claim 1, wherein the drainage unit comprises:

a drain to collect the liquid therein; and a pump connected to the drain to move liquid into the drain in response to rotation of the pump.

3. The air dispensing chamber of claim 1, further comprising:

a barrier movably disposed on at least a portion of the main body to move from closed in a first position to at least partially opened in a second position, and to move from opened in the second position to closed in the first position.

4. The air dispensing chamber of claim 1, further comprising:

at least one induction coil disposed within at least a portion of the main body to emit heat therefrom.

* * * * *